US011445284B2

(12) United States Patent
Kim et al.

(10) Patent No.: US 11,445,284 B2
(45) Date of Patent: Sep. 13, 2022

(54) PORTABLE AUDIO EQUIPMENT

(71) Applicant: LG ELECTRONICS INC., Seoul (KR)

(72) Inventors: Dongsung Kim, Seoul (KR); Byungduck Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/265,709

(22) PCT Filed: Aug. 30, 2018

(86) PCT No.: PCT/KR2018/010081

§ 371 (c)(1),
(2) Date: Feb. 3, 2021

(87) PCT Pub. No.: WO2020/045705

PCT Pub. Date: Mar. 5, 2020

(65) Prior Publication Data

US 2021/0195310 A1 Jun. 24, 2021

(51) Int. Cl.

| | |
|---|---|
| ***H04R 1/10*** | (2006.01) |
| ***G10L 25/51*** | (2013.01) |
| ***G10L 25/84*** | (2013.01) |
| ***H04R 1/08*** | (2006.01) |

(52) U.S. Cl.

CPC ..... *H04R 1/1041* (2013.01); *G10L 25/51* (2013.01); *G10L 25/84* (2013.01); *H04R 1/08* (2013.01); *H04R 1/1016* (2013.01); *H04R 1/1075* (2013.01); *H04R 2420/07* (2013.01)

(58) Field of Classification Search

CPC ..... H04R 1/1041; H04R 1/08; H04R 1/1016; H04R 1/1075; G10L 25/51; G10L 25/84

See application file for complete search history.

(56) References Cited

U.S. PATENT DOCUMENTS

| | | | | |
|---|---|---|---|---|
| 2014/0205131 | A1 | 7/2014 | Azmi et al. | |
| 2017/0026734 | A1 | 1/2017 | Walker et al. | |
| 2021/0250672 | A1* | 8/2021 | Han | H04R 1/1066 |
| 2021/0392445 | A1* | 12/2021 | Oosugi | G10L 21/0208 |

FOREIGN PATENT DOCUMENTS

| | | | |
|---|---|---|---|
| KR | 10-1469907 | B1 | 12/2014 |
| KR | 10-2016-0029637 | A | 3/2016 |
| KR | 10-2016-0091620 | A | 8/2016 |
| KR | 10-2017-0030366 | A | 3/2017 |
| KR | 10-2018-0064096 | A | 6/2018 |
| KR | 10-2018-0093363 | A | 8/2018 |

* cited by examiner

*Primary Examiner* — Simon King

(74) *Attorney, Agent, or Firm* — Birch, Stewart, Kolasch & Birch, LLP

(57) ABSTRACT

Portable audio equipment comprising: a housing comprising an acoustic passage that protrudes from one side thereof and has an open one end portion; a partition dividing the acoustic passage into a first acoustic passage and a second acoustic passage; an acoustic output unit for outputting sounds through the first acoustic passage; and inner microphone for collecting sounds through the second acoustic passage; and a control unit inside the housing, controlling the acoustic output unit so as to output sounds, and processing the sound collected through the inner microphone, can more effectively cancel external noise by further including the inner microphone for collecting sounds inputted through the body of a user.

7 Claims, 8 Drawing Sheets

(a)

(b)

(a)

(b)

(a)

(b)

PORTABLE AUDIO EQUIPMENT

CROSS REFERENCE TO RELATED APPLICATIONS

This application is the National Phase of PCT International Application No. PCT/KR2018/010081, filed on Aug. 30, 2018, all of which is hereby expressly incorporated by reference into the present application.

TECHNICAL FIELD

The present disclosure relates to a portable sound device for receiving a sound signal from a mobile terminal through wireless communication with the mobile terminal and transmitting a control signal for controlling the mobile terminal.

BACKGROUND ART

A portable sound device means an audio device that receives a sound signal from a mobile terminal and transmits audio information collected through a microphone to the mobile terminal. In the related art, the portable sound device is based on a cable mode for receiving a sound signal by inserting a terminal into an ear jack of the mobile terminal. However, needs for a portable sound device of a wireless communication mode are recently increasing in view of mobility and convenience in use.

A portable sound device includes an audio output module to perform functions such as music play and telephone conversation. The portable sound device may be connected to a base station in order to have a telephone conversation, may be directly connected to an external server in order to acquire audio data, or may be connected with another mobile terminal in order to perform the above functions through pairing.

Various types of portable sound devices based on the portability thereof, such as a headphone-type portable sound device, which is placed on the head of a user in the form of a hair band such that the user can carry the portable sound device, an ear-hanging type portable sound device, and an in-ear type portable sound device, have been developed.

A portable sound device collects a user's voice through a microphone and then stores or delivers the collected voice to a counterpart on the line as well as outputs sound. At this time, various algorithms are used to distinguish the user's voice from external noise, and a plurality of microphones are physically disposed at optimal locations as far as possible. However, as a portable sound device tends to be downsized so as to put some limitations on microphone disposition, it is difficult to collect optimal sound.

SUMMARY

An object of the present disclosure is to provide a portable sound device that receives a sound signal from a mobile terminal through wireless communication with the mobile terminal and transmits a control signal for controlling the mobile terminal, so as to provide a simpler structure by reducing the number of members of a rotary module.

There is provided a portable sound device comprising: a housing including an audio passage protruded toward one side, having an opened end portion; a partition dividing the audio passage into a first audio passage and a second audio passage; an audio output module for outputting sounds through the first audio passage; an inner microphone for collecting sounds through the second audio passage; and a controller packaged inside the housing, controlling the audio output module to output sounds and processing the sounds collected through the inner microphone.

The first sound passage may be greater than the second sound passage.

The portable sound device may further comprise an audio bracket coupled with at least one of the audio output module and the inner microphone and located at the other end portion of the audio passage.

The audio bracket may include a first seating portion formed on a first surface headed for the first sound passage and provided to seat the audio output module thereon; a second seating portion formed on a second surface and provided to seat the inner microphone thereon; and an audio hole formed on the second seating portion and opened toward the second audio passage.

The first seating portion may further include a sidewall connected with the partition.

The first seating portion may include an opening portion, and may further include a flexible substrate for connecting the audio output module with the controller by passing through the opening portion.

The bracket may have a flat surface which is in contact with the housing, and the portable sound device may further comprise a waterproof tape interposed on the contact surface between the bracket and the housing.

The second audio passage may have one end narrower than the other end.

The portable sound device may further comprise at least one outer microphone located at the other side of the housing, wherein the controller may distinguish a user's voice from external noise by using a difference between sound collected in the inner microphone and sound collected in the outer microphone.

Advantageous Effects

The portable sound device according to the present disclosure may more effectively remove external noise by further including an inner microphone for collecting sounds input through a user's body.

Also, a speaker's sound may be prevented from entering an inner microphone through a partition. Also, since a waterproof tape may be used for adhesion between an audio bracket and a housing, it is advantageous in that a separate member such as a waterproof ring is not required.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BEST MODE FOR CARRYING OUT THE INVENTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
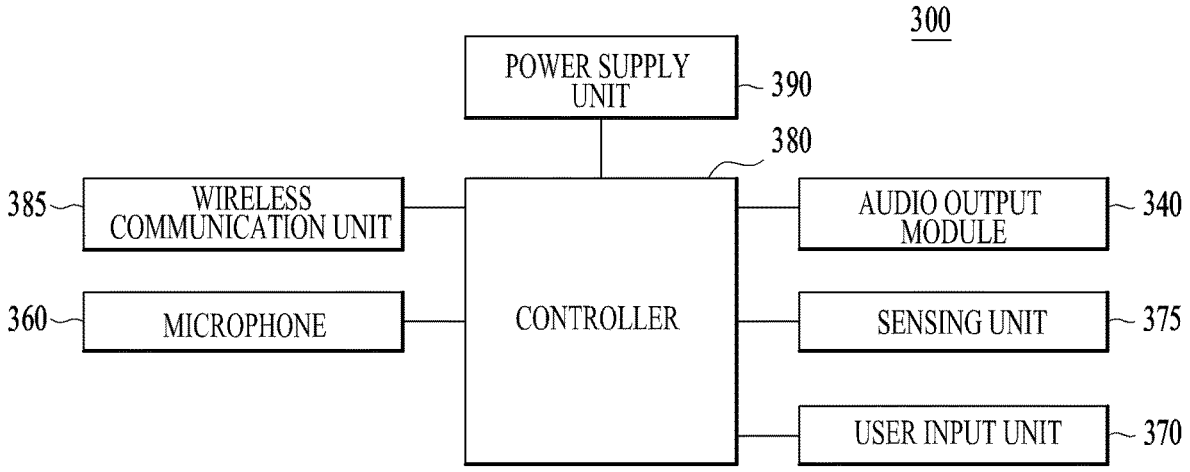
FIG. 1 is a block diagram illustrating a portable sound device according to the present disclosure.
Figure 2:
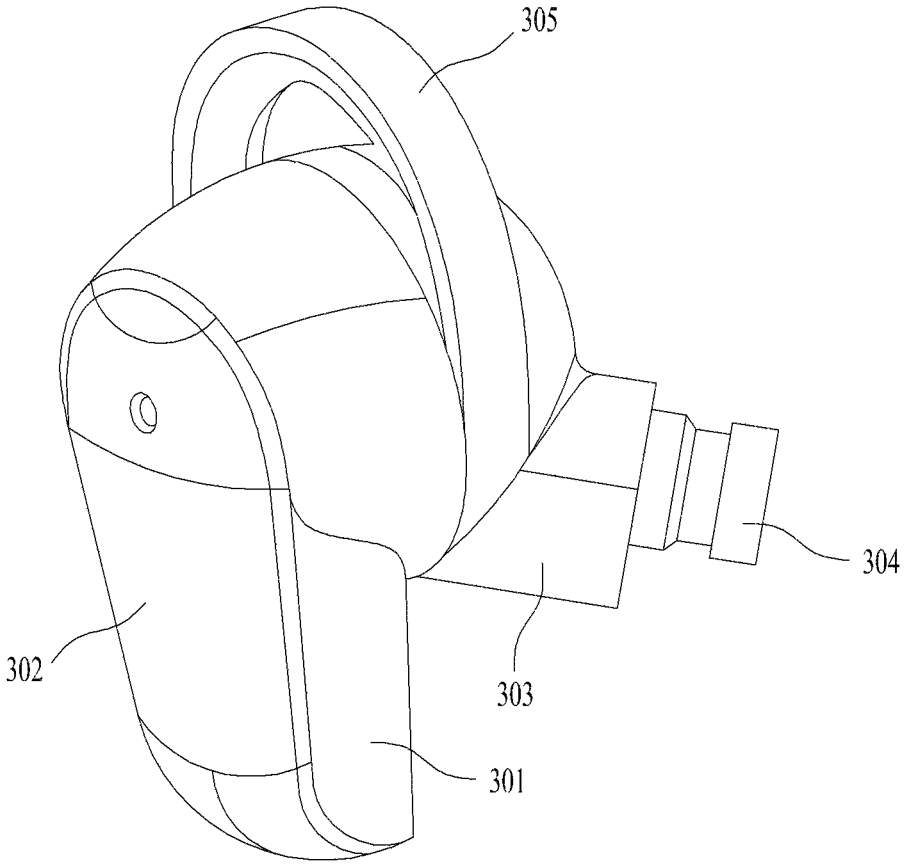
FIG. 2 is a perspective view illustrating a portable sound device according to one embodiment of the present disclosure, which is viewed in one direction.
Figure 3:
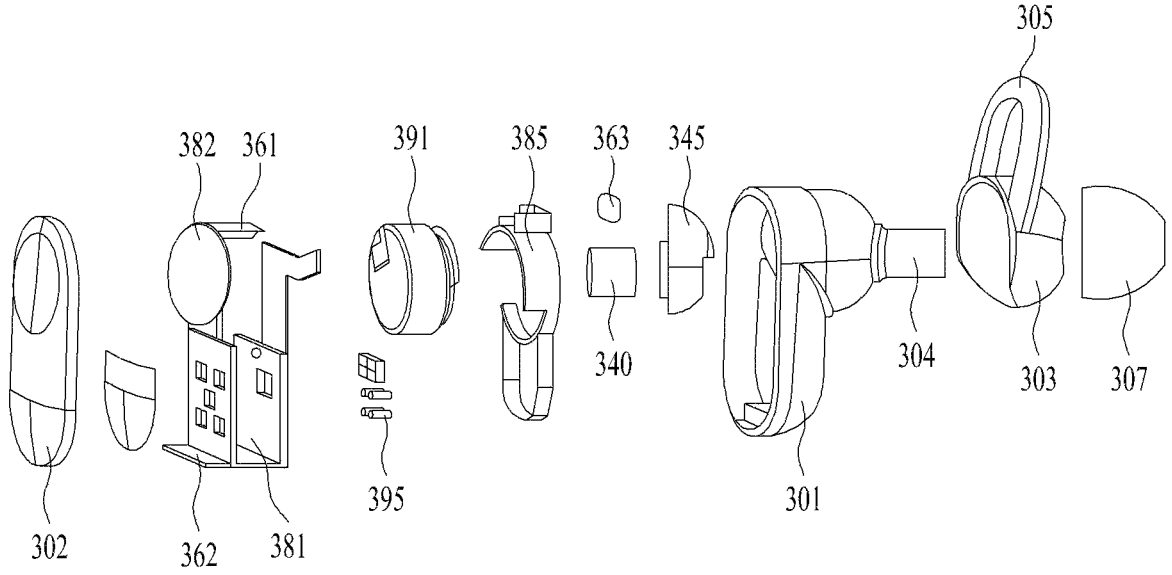
FIG. 3 is an exploded perspective view illustrating a portable sound device according to one embodiment of the present disclosure.

FIG. 1 is a block diagram of a portable sound device 300 according to an embodiment of the present invention. FIG. 2 is a perspective view of the portable sound device 300 according to the embodiment of the present invention when viewed in one direction. FIG. 3 is an exploded perspective view illustrating a portable sound device 300 according to one embodiment of the present disclosure. For convenience in describing the structure of the portable sound device 300 shown in FIG. 1, reference is also to be made to FIG. 2.

The portable sound device 300 according to the embodiment of the present invention includes a controller 380, a wireless communication unit 385, an audio output module 340, a sensing unit 375, a microphone 360, a user input unit 370, and a power supply unit 390.

The portable sound device 300 of the present disclosure forms an inner space in which electronic components are packaged, by a plurality of housings 301 and 302, wherein the second housing 302 coupled to one side of the first housing 301 is a portion exposed to the outside when a user wears the portable sound device 300, and the audio output module 340 for outputting sound in accordance with a sound signal is located at the other side of the first housing 301 and therefore provided with an audio passage 304 for delivering sound to a user. For convenience of packaging of the first housing 301, the portion where the audio passage 304 is located may be detached, whereby separate housings may be configured, and three housings may be coupled to one another to form an inner space.

Alternatively, as shown, a third housing 303 of a flexible material may be provided for wearing of a portion directly touched with a user's ear, and a fixed ring 305 may further be provided such that the third housing 303 may be fixed to be hung in antihelix of the user's ear.

The portable sound device 300 of the present disclosure may be provided with the audio passage 304 protruded to be inserted into the user's alveary, as a kernel type, and an ear tip 307 may be coupled to the outside of the audio passage 304 and thus may be tightly adhered to the user's ear.

The microphone 360 processes an external sound signal into electrical voice data. The processed voice data is transmitted to an external terminal or an external server via the wireless communication unit 385. The microphone 360 may use various noise removal algorithms for removing noise generate when receiving an external sound signal.

Figure 4:
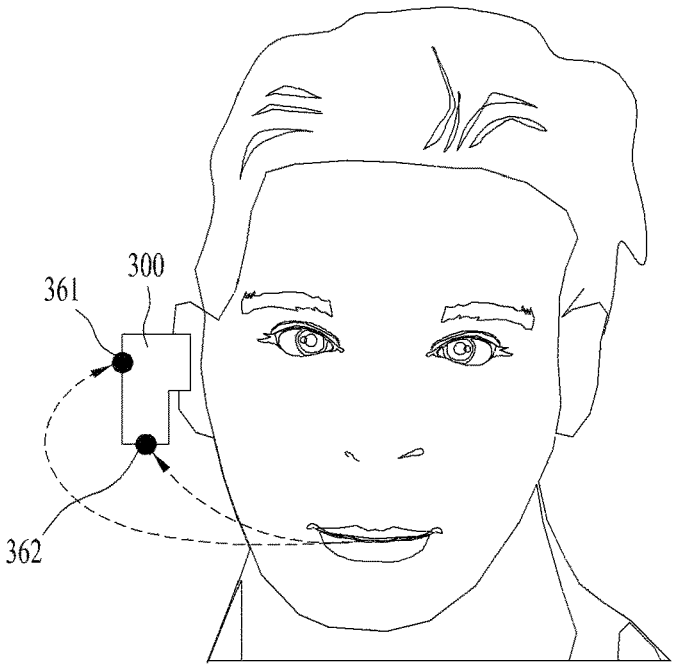
FIG. 4 is a view illustrating collection of sound spoken by a user through a plurality of microphones.
Figure 4:
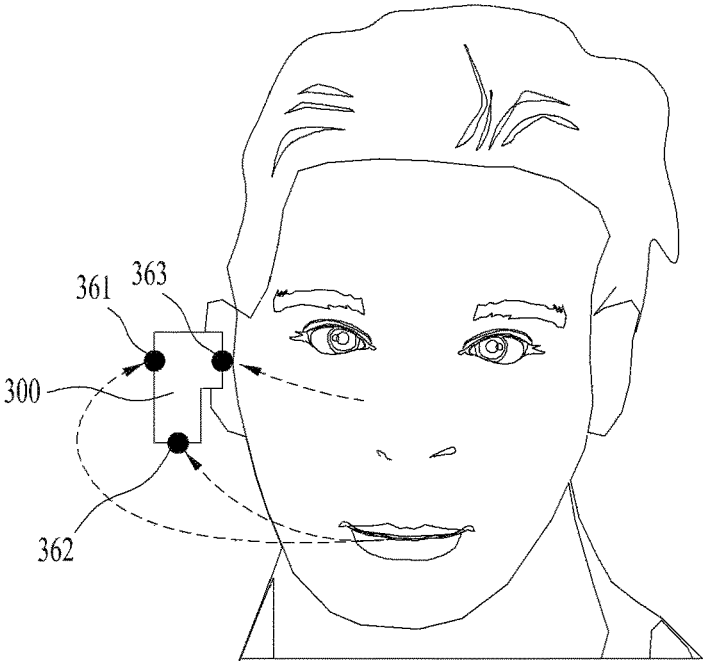

FIG. 4 is a view illustrating collection of sound spoken by a user through a plurality of microphones. FIG. 4(*a*) illustrates that two microphones are provided, and FIG. 4(*b*) illustrates that three microphones are provided.

The microphones 360 of the present disclosure may be provided in plural number to remove noise by combining various sounds. As shown in FIG. 4(*a*), two microphones 361 and 362 may be disposed at their respective positions different from each other such that voice spoken by the user may be distinguished from external noise by using a time difference, a volume difference, etc. of sounds collected by each of the microphones 361 and 362.

Additionally, in the case that a third microphone 363 for collecting sound delivered through an Eustachian tube located in the user's ear is additionally provided as shown in FIG. 4(*b*), three sounds may be combined to remove external noise. Particularly, since the user's sound which is the loudest and has the smallest external noise may be collected by the third microphone, the third microphone has an optimal structure in removing external noise. The sensing unit 375 recognizes the state of the portable sound device 300 and the surroundings of the portable sound device 300. The sensing unit 375 may include an illuminance sensor for sensing brightness around the portable sound device 300, a touch sensor for sensing a touch input, and a gyro sensor for sensing the tilt and position of the portable sound device 300.

The user input unit 370 is an input unit for controlling the portable sound device 300 by a user, and the portable sound device 300 which is a small size like the present disclosure is limited the number of buttons. Control commands may be expanded by combining of button inputs or varying a press time of button or number of pressing of buttons.

The power supply unit 390 may supply a power required for the controller and each component, and a button type battery 391 may be used to be packaged in a small space. Since a size of the battery 391 determines a use time of the portable sound device 300, it is required to make sure of a wide space if possible, some substrates may be disposed to be overlapped with each other to enlarge a possible packaging space. The power supply unit 390 may include a power terminal for connection with an external power source, so as to charge the battery 191. The power terminal is in contact with a power terminal formed in a cradle in which the portable sound device 300 is packaged, and therefore the external power source is applied thereto.

A printed circuit board 381 is located in the housing as the controller 380, and since a plurality of ICs are packaged in the printed circuit board 381, if the printed circuit board 381 is disposed to overlap the battery 391, a problem occurs in that its thickness becomes thick. Therefore, the printed circuit board 381 is disposed so as not to overlap the battery 391, and a flexible substrate 382 may be used for packaging and connection of some components such as the microphone, the user input unit and the audio output module 340.

The wireless communication unit 385 means a device for performing wireless communication with another mobile terminal or base station, and includes an antenna for transmission and reception of a radio signal. If the antenna is touched with the user's body, its radiation performance is deteriorated, the antenna may be located in the second housing 302 so as not to be touched with the user's body when the user wears the portable sound device.

A main bracket may be used to fix the flexible substrate 382, the printed circuit board 381, the battery 391 and the microphone. The printed circuit board, the battery 391, the flexible substrate 382 and the microphone may be packaged in the main bracket and assembled into one assembly, whereby the assembly may easily be packaged in the housing.

Figure 5:
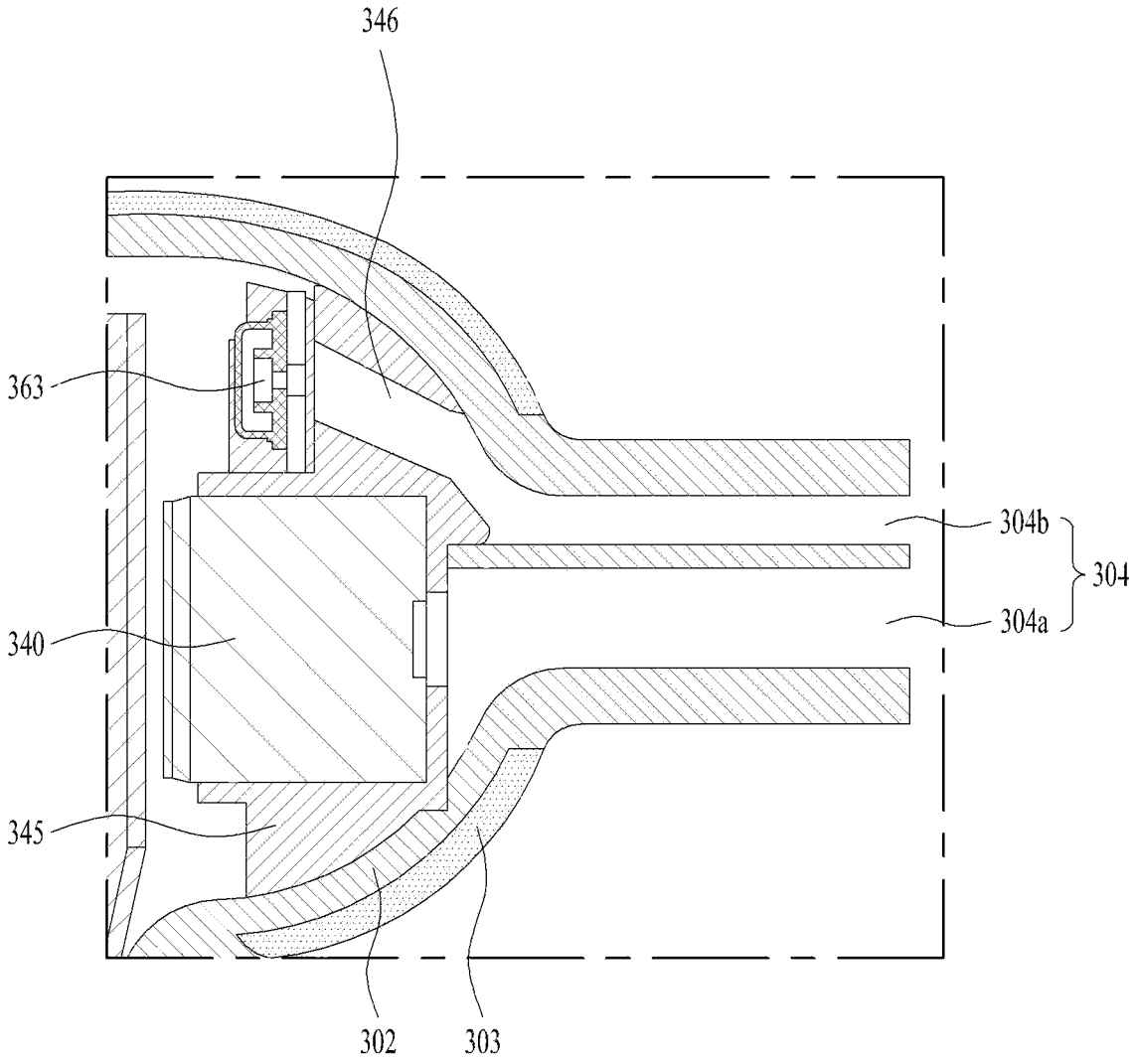
FIG. 5 is a view illustrating one embodiment of a portable sound device according to one embodiment of the present disclosure.

FIG. 5 is a view illustrating one embodiment of a portable sound device 300 according to one embodiment of the present disclosure. As described above, the third microphone for collecting audio input through the user's ear may be disposed in the audio passage 304 for the audio output module 340.

However, a problem occurs in that the sound output through the audio output module 340 is input to the microphone as it is, in order to minimize the problem, a partition 304*c* may be formed in the audio passage 304 to partition a first audio passage 304*a* for the audio output module 340 and a second audio passage 304*b* for the microphone. A sectional area of the first audio passage 304*a* may be formed to be greater than that of the second audio passage 304*b* as much as twice to actively output the sound from the audio output module 340. If the partition 304*c* is thick, the sound of the audio output module 340, which is delivered to the microphone, may be minimized, but a problem occurs in that a width of the audio passage 304 becomes narrow.

An audio bracket 345 may further be provided such that the audio output module 340 and the microphone 363 are exactly disposed in the first audio passage 304*a* and the second audio passage 304*b*. The audio bracket 345 includes the first audio passage 304*a* and a hole connected with the second audio passage 304*b*. The microphone 363 connected with the second audio passage 304*b* may be provided with an auxiliary audio passage 346 to be connected to the position of the microphone 363 in the audio bracket 345 as shown in FIG. 5. The auxiliary audio passage 346 formed in the audio bracket 345 may be formed to have an area from 0.5 $mm^2$ to 4 $mm^2$. Since the auxiliary audio passage has a sectional area wider than that of the second audio passage, the sound may be amplified and then collected in the microphone 363.

Figure 6:
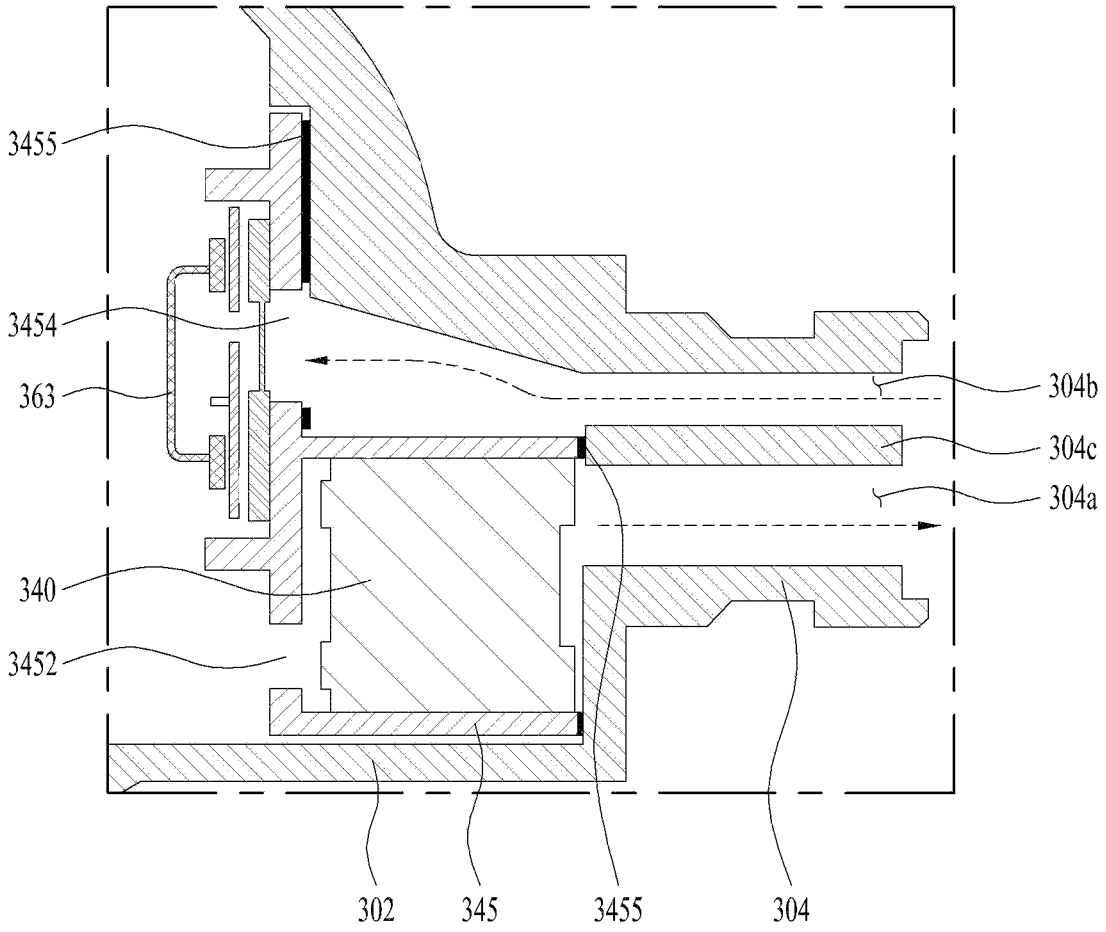
FIG. 6 is a view illustrating another embodiment of a portable sound device according to the present disclosure.

FIG. 6 is a view illustrating another embodiment of a portable sound device 300 according to the present disclosure. In FIG. 6, the microphone is disposed behind the speaker, whereby a size of the portion adjacent to the audio passage 304 may be reduced. If the microphone is disposed to adjoin the audio passage 304 like the audio output module 340, the problem that the user's wearing effect is deteriorated due to a great size of a portion touched with the user's ear may be solved.

Figure 7:
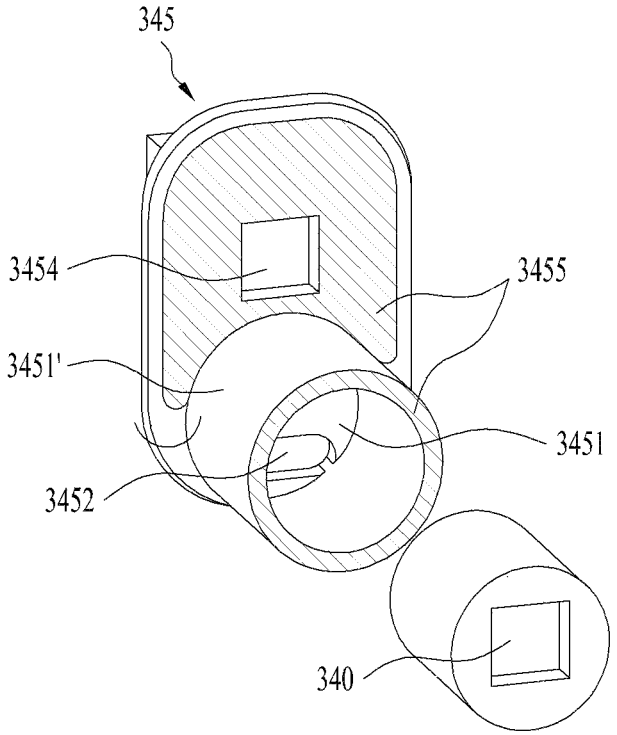
FIG. 7 is a view illustrating that an audio bracket, a microphone and a speaker of FIG. 6 are coupled to one another.
Figure 7:
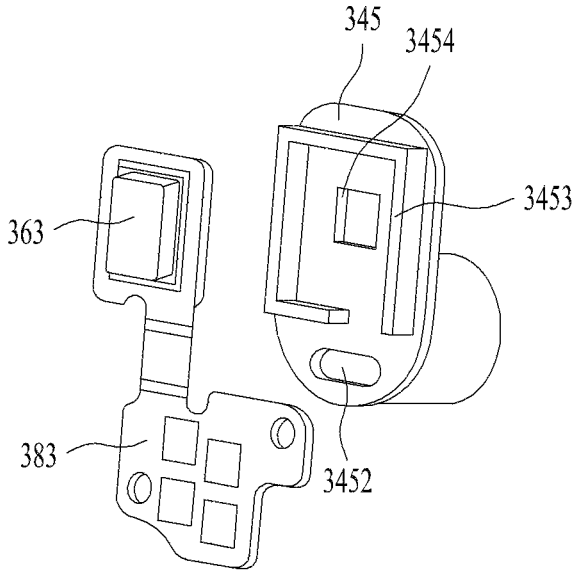

FIG. 7 is a view illustrating that the audio bracket 345, the microphone and the speaker of FIG. 6 are coupled to one another, wherein the audio output module 340 may be coupled on one surface and the microphone may be coupled in a direction of the other surface. A first seating portion 3451 to which the audio output module 340 is coupled may be provided with a hole 3452 for passing through a cable connecting the printed circuit board with the audio output module 340 or the flexible substrate 382, and a second seating portion 3453 on which the microphone is seated may be provided with an audio hole 3454 for allowing the sound entering there through the second audio passage 340*b* to reach the microphone.

The first seating portion 3451 may further include a sidewall 3451' on which the audio seating portion is seated as shown in FIG. 7. The sidewall 3451' may constitute a portion of the partition 304*c* as shown in FIG. 6. In this case, a portion of the second audio passage 304*b* may be formed by the sidewall 3451' of the audio bracket 345.

The second audio passage may be formed to have a tapered shape which becomes greater when adjoining the microphone 363 as shown in FIG. 6. An inlet of the second audio passage 304*b* is a portion inserted into the user's alveary and has a limitation in its size but the sound collected by the microphone 363 may be amplified, whereby quality of the sound collected by the microphone 363 may be improved.

An adhesive tape 346 adhering the audio bracket 345 to the housing may be used for waterproof. That is, the audio bracket 345 may be adhered to the housing by an adhesive tape 3455 having elasticity. Since the audio bracket 345 shown in FIG. 5 has a curved surface that is in contact with the housing, the adhesive tape 346 may be used therefor. However, in this embodiment, since a contact surface of the audio bracket with the housing is a flat surface, waterproof may be implemented using the adhesive tape.

Figure 8:
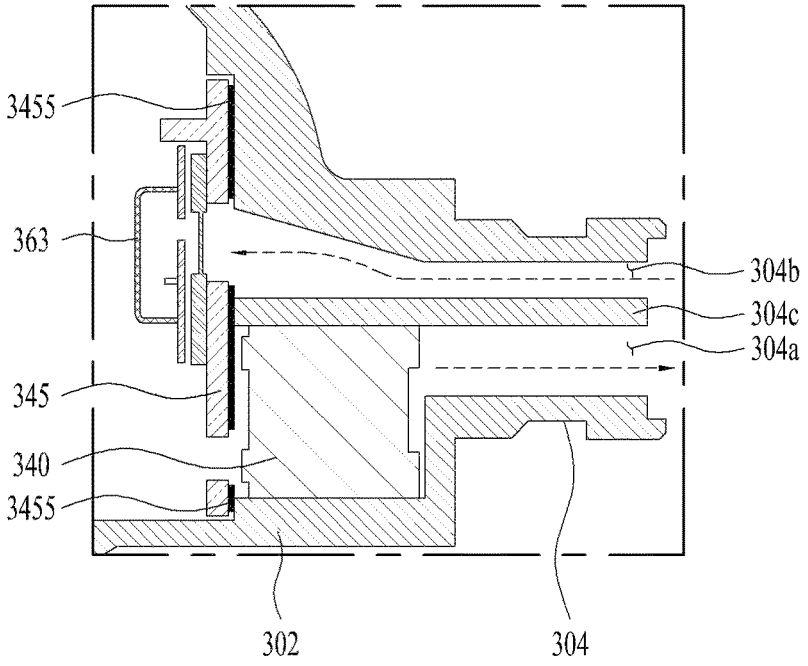
FIG. 8 is a view illustrating another embodiment of a portable sound device according to the present disclosure.
Figure 8:
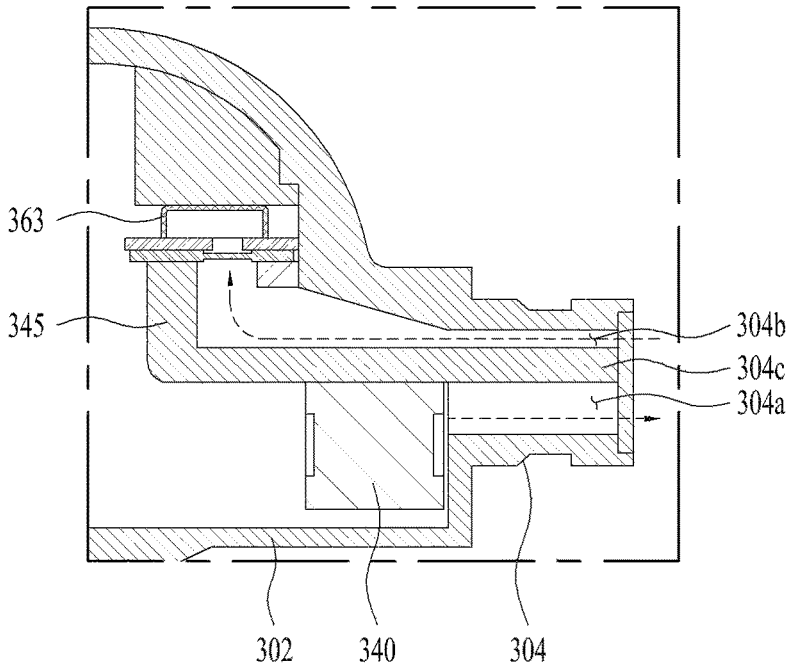

FIG. 8 is a view illustrating another embodiment of a portable sound device 300 according to the present disclosure. In case of the audio bracket of FIG. 8(*a*) unlike the aforementioned audio bracket 345 in which the first seating portion 3451 partially constitutes a portion of a partition, the partition 304*c* is implemented in a single body with the housing and the first seating portion 3451 is omitted from the audio bracket 345 in this embodiment. In such an embodiment, the audio output module 340 may first be packaged in the housing and then the microphone may be assembled in such a manner that the audio bracket 345 packaged in the second seating portion 3453 is coupled to the housing.

When the microphone is disposed in another direction without facing the second audio passage 304*b*, the audio bracket 345 comprising an auxiliary audio passage for guiding the microphone may be used as the audio bracket 345 of FIG. 8(*b*).

As described above, the portable sound device of the present disclosure may more effectively remove external noise by further including an inner microphone for collecting sounds input through a user's body.

Also, a speaker's sound may be prevented from entering the inner microphone through a partition. Also, since a waterproof tape may be used for adhesion between an audio bracket and a housing, it is advantageous in that a separate member such as a waterproof ring is not required.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A portable sound device comprising:

a housing including an audio passage protruded toward one side, having an opened end portion;

a partition dividing the audio passage into a first audio passage and a second audio passage;

an audio bracket including a first seating portion formed on a first surface headed for the first audio passage, a second seating portion formed on a second surface, and an audio hole formed on the second seating portion and opened toward the second audio passage;

an audio output module seated on the first seating portion for outputting sounds through the first audio passage;

an inner microphone seated on the second seating portion for collecting sounds through the second audio passage; and a controller packaged inside the housing, controlling the audio output module to output sounds and processing the sounds collected through the inner microphone.

2. The portable sound device of claim 1, wherein a sectional area of the first sound passage is greater than a sectional area of the second sound passage.

3. The portable sound device of claim 1, wherein the first seating portion further includes a sidewall connected with the partition.

4. The portable sound device of claim 1, wherein the first seating portion includes an opening portion, and further includes a flexible substrate for connecting the audio output module with the controller by passing through the opening portion.

5. The portable sound device of claim 1, wherein the bracket has a flat surface which is in contact with the housing, and the portable sound device further comprising a waterproof tape interposed on the contact surface between the bracket and the housing.

6. The portable sound device of claim 1, wherein the cross-sectional area of the second audio passage increases as closer to the microphone.

7. The portable sound device of claim 1, further comprising at least one outer microphone located at the other side of the housing, wherein the controller distinguishes a user's voice from external noise by using a difference between sound collected in the inner microphone and sound collected in the outer microphone.

* * * * *